US009093189B2

(12) United States Patent
Frunder

(10) Patent No.: US 9,093,189 B2
(45) Date of Patent: Jul. 28, 2015

(54) PANELING APPARATUS FOR A CEILING OR A WALL OF A ROOM

(71) Applicant: OSRAM GmbH, Munich (DE)

(72) Inventor: Tobias Frunder, Augsburg (DE)

(73) Assignee: Osram GmbH, Munich (DE)

( * ) Notice: Subject to any disclaimer, the term of this patent is extended or adjusted under 35 U.S.C. 154(b) by 25 days.

(21) Appl. No.: 14/016,342

(22) Filed: Sep. 3, 2013

(65) Prior Publication Data

US 2014/0060888 A1 Mar. 6, 2014

(30) Foreign Application Priority Data

Sep. 5, 2012 (DE) ..... 10 2012 215 703

(51) Int. Cl.

| | |
|---|---|
| ***F21S 8/00*** | (2006.01) |
| ***H01B 1/04*** | (2006.01) |
| ***E04F 13/074*** | (2006.01) |
| *F21V 21/002* | (2006.01) |
| *F21V 29/00* | (2015.01) |
| *F21S 8/02* | (2006.01) |
| *F21V 21/30* | (2006.01) |
| *F21Y 101/02* | (2006.01) |

(52) U.S. Cl.

CPC ..... *H01B 1/04* (2013.01); *E04F 13/074* (2013.01); *F21S 8/026* (2013.01); *F21V 21/002* (2013.01); *F21V 21/30* (2013.01); *F21V 29/30* (2013.01); *F21Y 2101/02* (2013.01)

(58) Field of Classification Search

CPC ..... H01B 1/04; E04F 13/074; F21S 8/026; F21V 29/30; F21V 21/30; F21V 21/002; F21Y 2101/02

USPC ..... 362/145, 147–150

See application file for complete search history.

(56) References Cited

U.S. PATENT DOCUMENTS

| | | | | |
|---|---|---|---|---|
| 5,342,204 | A * | 8/1994 | Och | 439/39 |
| 6,527,406 | B1 * | 3/2003 | Slesinger et al. | 362/127 |
| 8,314,336 | B2 * | 11/2012 | Liang et al. | 174/68.1 |
| 8,651,711 | B2 * | 2/2014 | Rudisill et al. | 362/398 |

(Continued)

FOREIGN PATENT DOCUMENTS

| | | | |
|---|---|---|---|
| FR | 2712377 | A1 | 5/1995 |
| JP | 07220653 | A * | 8/1995 |
| JP | 2006269358 | A * | 10/2006 |

OTHER PUBLICATIONS

Machine Teanslation of FR 2712377 A1.*
English abstract of FR 2712377 A1 dated May 19, 1995.

*Primary Examiner* — Anne Hines
*Assistant Examiner* — Jose M Diaz

(57) ABSTRACT

A paneling apparatus for a ceiling or a wall of a room is provided, which may include: two electrically conductive conduction layers, arranged to overlap. First layers between which at least one insulation layer, which electrically insulates the conduction layers from one another, is arranged with, at least one contact-making device which, in a subregion, is accommodated in the layers and which has a first contact region. One of the conduction layers makes electrical contact, and has a second region, with which the other conduction layer makes electrical contact and is electrically insulated from the first region. The conduction layers may make electrical contact with at least one lighting element, holding the lighting element on the layers. The device is arranged on the layers and can move relative thereto.

15 Claims, 2 Drawing Sheets

(56) References Cited

U.S. PATENT DOCUMENTS

2006/0012977 A1* 1/2006 Joseph ..... 362/147
2006/0198128 A1* 9/2006 Piepgras et al. ..... 362/147
2009/0122528 A1* 5/2009 Tsai et al. ..... 362/147
2012/0138338 A1* 6/2012 Kim et al. ..... 174/250

* cited by examiner

PANELING APPARATUS FOR A CEILING OR A WALL OF A ROOM

CROSS-REFERENCE TO RELATED APPLICATION

This application claims priority to German Patent Application Serial No. 10 2012 215 703.4, which was filed Sep. 5, 2012, and is incorporated herein by reference in its entirety.

TECHNICAL FIELD

Various embodiments relate generally to a paneling apparatus for a ceiling or a wall of a room.

BACKGROUND

Various embodiments proceed from a paneling apparatus which is known from the prior art for a ceiling or a wall of a room, which paneling apparatus includes two electrically conductive conduction layers, which are arranged such that they overlap at least in regions, as first layers.

At least one insulation layer, which electrically insulates the conduction layers from one another, is arranged between the conduction layers (first layers) as a further layer of the paneling apparatus. The paneling apparatus additionally includes at least one contact-making device which, at least in a subregion, is accommodated in the layers and which has a first contact region, with which one of the conduction layers makes electrical contact, and has a second contact region, with which the other conduction layer makes electrical contact and which is electrically insulated from the first contact region.

Furthermore, the contact-making device is designed to enable the conduction layers to make electrical contact with at least one lighting element and also to hold the lighting element on the layers. In other words, the conduction layers can make electrical contact with the lighting element and the lighting element can be held on the layers by means of the contact-making device,

SUMMARY

In various embodiments, a paneling apparatus for a ceiling or a wall of a room is provided. The paneling apparatus may include: two electrically conductive conduction layers, which are arranged such that they overlap at least in regions, as first layers between which at least one insulation layer, which electrically insulates the conduction layers from one another, is arranged as a further layer, and having at least one contact-making device which, at least in a subregion, is accommodated in the layers and which has a first contact region, with which one of the conduction layers makes electrical contact, and has a second contact region, with which the other conduction layer makes electrical contact and which is electrically insulated from the first contact region, and is designed to enable the conduction layers to make electrical contact with at least one lighting element and also to hold the lighting element on the layers, wherein the contact-making device is arranged on the layers such that it can move relative to the layers.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
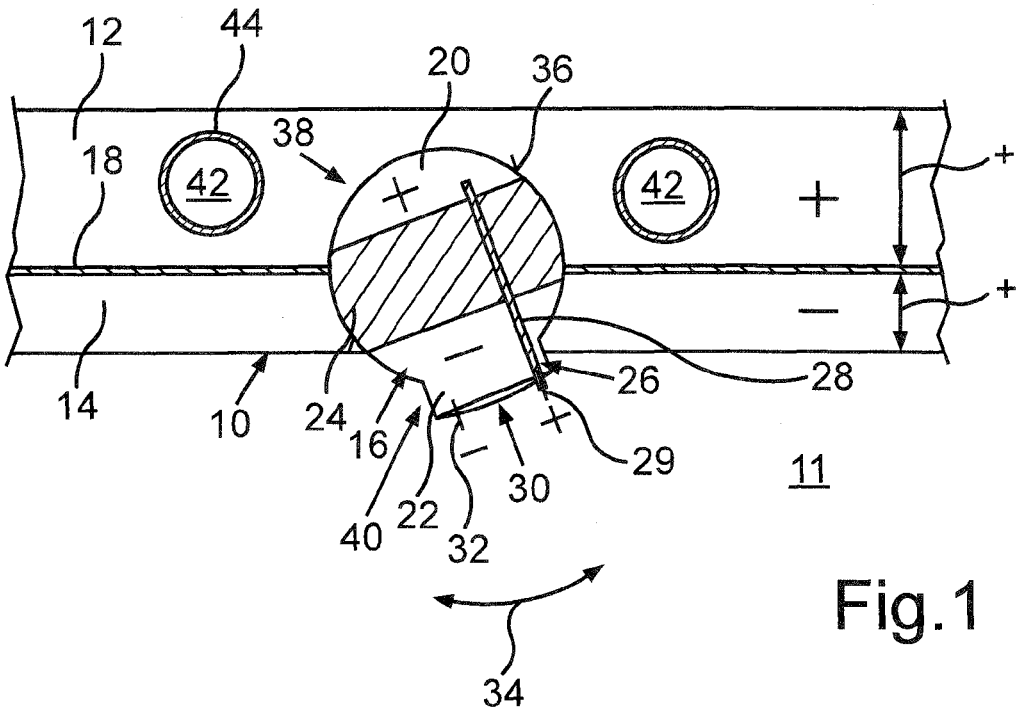
FIG. 1 shows a schematic side view of a detail of a first exemplary embodiment of a paneling apparatus according to various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a paneling apparatus for a ceiling or a wall of a room, which paneling apparatus allows the room to be illuminated in a particularly advantageous manner.

In order to provide a paneling apparatus which allows the room to be illuminated in a particularly advantageous manner, provision is made, according to various embodiments, for the contact-making device to be arranged on the layers such that it can move relative to the layers. It is therefore possible to adjust the contact-making device and, by means of said contact-making device, the lighting element relative to the layers and to correspondingly orient them such that the room can be illuminated by means of the lighting element in a specific manner and as required.

This adjustment of the lighting element as required can be realized in a particularly simple manner in the case of the paneling apparatus according to various embodiments since the contact-making device can be moved relative to the layers and does not, for example, first have to be removed, changed in respect of its orientation and then fitted to the layers again. In other words, the contact-making device can be moved, in various embodiments pivoted, relative to the layers in its state in which it is held on the layers. It may be provided that the layers are composed of a material which has a certain degree of elasticity. In this case, it is possible to fix the contact-making device in a desired position without problems.

In this case, the contact-making device is assigned three functions since it serves both to allow the conduction layers to make electrical contact with the lighting element and also to hold the lighting element on the layers. Furthermore, the contact-making device serves for adjustment of the lighting element relative to the layers in a particularly simple and specific manner and also as required.

Provision is preferably made for the contact-making device to be thermally coupled to at least one of the layers, in various embodiments to at least one of the conduction layers. As a result of this thermal coupling, heat can be dissipated from the contact-making device and, by means of said contact-making device, from the lighting element, in various embodiments by thermal conduction, with the result that additional heat sinks for cooling the contact-making device and/or the lighting element can be dispensed with if desired. As a result, the costs and the weight of the paneling apparatus can be kept particularly low.

In various embodiments, provision is made for the contact-making device to have, at least in its subregion which is accommodated in the layers, an outer contour which is of at least partially convex design. As a result, the contact-making device and, by means of said contact-making device, the lighting element can be adjusted in a particularly simple manner and as required.

In various embodiments, provision is made for the outer contour to be designed to be at least substantially in the form of a sphere or in the form of a segment of a sphere or in the form of a circular cylinder, in various embodiments of a straight circular cylinder, in the subregion. As a result, the contact-making device can be pivoted relative to the layers over a particularly large pivot range. Furthermore, the contact-making device can be produced in a cost-effective manner.

It has proven particularly advantageous when the contact-making device is held in an interlocking manner on at least one of the layers. Therefore, additional and separate fastening elements for holding the contact-making device on the layers are not provided and are not required, as a result of which the paneling apparatus can exhibit a particularly low weight and also low costs.

In this case, provision can be made for the contact-making device to be at least partially pressed into the layers and, as a result, to be inserted into the layers. Therefore, the contact-making device can be fitted to the layers in a particularly simple and also time- and cost-effective manner.

In order to cool the contact-making device particularly well, at least one channel is at least partially provided in at least one of the layers, in various embodiments in at least one of the conduction layers, in various embodiments, it being possible for a cooling medium, in various embodiments a cooling liquid, to flow through said channel. As a result, particularly large quantities of heat can be transported away from the contact-making device and, by means of said contact-making device, from the lighting element over an only short period of time, with the result that a good cooling performance is displayed.

In this case, the channel through which the cooling medium can flow can be delimited by the at least one layer in which the channel is provided at least in regions.

In various embodiments, provision is made for the channel to be delimited by at least one conduction element which is formed from a first material and is accommodated at least partially in the at least one layer, wherein the first material differs from a second material from which the at least one layer, in which the channel is provided, is formed.

In other words, a conduction element which is produced separately from the at least one layer is provided, said conduction element being accommodated at least partially in the at least one layer and it being possible for cooling medium to flow through said conduction element. As a result, the at least one layer and also the conduction element can be produced in a particularly simple manner. Furthermore, the conduction element can be integrated in the at least one layer in a simple and therefore time- and cost-effective manner. Furthermore, the conduction element can be coupled to a cooling circuit, through which the cooling medium can flow, in a particularly simple manner as a result.

In various embodiments, provision is made for the conduction layers to have different layer thicknesses from one another. The manner in which the contact-making device is accommodated in the layers and also the ability of the contact-making device to move in relation to the layers can be set as required as a result. This can also be of benefit for simple fitting of the contact-making device to the layers.

In various embodiments, the conduction layers are formed at least substantially from carbon, in various embodiments from graphite and in various embodiments from expanded graphite. As a result, the conduction layers have firstly a very high degree of electrical conductivity and secondly a very high degree of thermal conductivity, with the result that the contact-making device can not only be supplied with electric current by means of the conduction layers, but can also be cooled in a very effective manner. In various embodiments, the expanded graphite allows current to be supplied to the contact-making device in a particularly effective manner and also allows heat to be dissipated from the contact-making device in a particularly effective manner, with the result that additional and separate heat sinks for cooling the contact-making device can be avoided.

The lighting element which is to be held on the contact-making device and is to be electrically coupled to the conduction layers by means of said contact-making device may be, for example, a light-emitting diode (LED) or an LED module having a plurality of light-emitting diodes (LEDs). Similarly, said lighting element can also be another kind of lighting element by means of which light beams can be emitted.

FIG. 1 shows a schematic side view of a first exemplary embodiment of a paneling apparatus, which is designated 10 overall, for a ceiling or a wall of a room 11. In other words, the paneling apparatus 10 serves to panel the ceiling or the wall at least in regions. The paneling apparatus 10 includes two electrically conductive conduction layers, specifically a first conduction layer 12 and a second conduction layer 14. The first conduction layer 12 has an extent which is at least substantially flat and is formed by a flat element, in various embodiments a plate. The second conduction layer 14 also has an at least substantially flat extent and is formed by a flat element, for example a plate.

In this case, the conduction layers 12, 14 are each produced from expanded graphite and therefore have both a very high degree of electrical conductivity and also a very high degree of thermal conductivity.

An insulation layer 18 which has an at least substantially flat extent and is formed, for example, likewise by a plate is arranged between the conduction layers 12, 14 as the further layer. The insulation layer 18 constitutes an insulation element by means of which the conduction layers 12, 14 are electrically insulated from one another. This means that the insulation layer 18 is not electrically conductive. In this case, the conduction layers 12, 14 are spaced apart from one another by means of the insulation layer 18. The conduction layers 12, 14 bear flat against the insulation layer 18.

The paneling apparatus 10 also has a contact-making device in the form of a mount 16 which is usually also called a lamp mount and is accommodated in the layers in a subregion, that is to say in the conduction layers 12, 14 and also in the insulation layer 18. In the present case, the mount 16 passes through the second conduction layer 14 and also the insulation layer 18 via respective passage openings, which correspond to the mount 16, in the conduction layer 14 and in the insulation layer 18 and is accommodated in an accommodation opening in the first conduction layer 12, without passing through the conduction layer 12.

As can be seen in FIG. 1, the mount 16 has a first contact region 20 with which the first conduction layer 12 makes electrical contact. Furthermore, the mount 16 has a second contact region 22 with which the second conduction layer 14 makes electrical contact. In this case, the contact regions 20, 22 are electrically insulated from one another by means of an insulation region 24 of the mount. The insulation region 24 is formed, for example, by at least one insulation element, that is to say an electrically non-conductive element of the mount 16.

The contact regions 20, 22 and also the insulation region 24 can be formed, for example, by respective individual elements which are produced separately from one another and which can be connected to one another after being produced. To this end, the individual elements are, for example, adhesively bonded to one another, with the result that the individual elements which form the contact regions 20, 22 are adhesively bonded to the individual element which forms the insulation region 24 by means of the respective adhesive-bonding areas.

In the present case, the first conduction layer 12 forms a positive electrical pole, which is identified by +, while the second conduction layer 14 forms a negative electrical pole, which is identified by –, by corresponding, electrical contact-connection, that is to say by applying an electrical voltage to the conduction layers 12, 14. Accordingly, the first contact region 20 forms a positive electrical pole, which is identified by +, of the mount 16, while the second contact region 22 forms a negative electrical pole, which is identified by –, of the mount 16.

To this end, the conduction layers 12, 14 are electrically connected, for example, to a current source. FIG. 1 shows that conduction elements with metal wires, for example copper wires, or similar lines are not provided and are not necessary for applying the electrical voltage to the mount 16. Instead, the electrical conductivity of the conduction layers 12, 14 is used in order to electrically contact-connect the mount 16 to the current source by means of the conduction layers 12, 14 and accordingly to supply said mount with electric current.

In this case, the conduction layers 12, 14 are formed at least substantially from expanded graphite and therefore have a very high degree of electrical conductivity. Furthermore, the conduction layers 12, 14 have a very high degree of thermal conductivity as a result, with the result that waste heat from the mount 16 can be transported away by means of the conduction layers 12, 14 in a particularly effective manner. As a result, additional and separate cooling elements, for example heat sinks with cooling ribs, for cooling the mount 16 can be avoided.

The mount 16 is formed, at least in its contact regions 20, 22, from a material with a high degree of electrical conductivity and also a high degree of thermal conductivity, with the result that the mount 16 can firstly be supplied with electric current in a particularly effective manner and secondly can be cooled in a particularly effective manner as a result. On account of the correspondingly effective thermal conductivity both of the mount 16 and also of the conduction layers 12, 14, heat can be transferred from the mount 16 to the conduction layers 12, 14 in a highly effective manner, in various embodiments by virtue of thermal conduction. The conduction layers 12, 14 can, for their part, be cooled, for example, by convection, with the result that heat can be transported away from the conduction layers 12, 14 by convection.

A leadthrough 26 which includes a guide element 28 is provided in order to make contact with the contact region 20. In this case, the guide element 28 has a guide channel, which is not shown in FIG. 1, in which a conductor 29, for example a metal wire, can be guided. The conductor 29 can be guided out of the guide element 28 via a corresponding opening in the guide element 28 and therefore firstly the contact region 20 can make electrical contact with said conductor. As a result, the positive electrical pole of the mount 16 can be guided to a fitting plate 30 of the mount 16, with the result that the conductor 29 secondly provides the positive pole. The negative pole is provided on the fitting plate 30 by a further, electrical conductor 32, wherein the contact region 22 makes electrical contact with the conductor 32.

The fitting plate 30 serves to hold a lighting element, which is not illustrated in FIG. 1, for example an LED module having a plurality of LEDs, on the mount 16. In this case, the electrical conductors 29, 32 constitute contact-making elements with which electrical contact can be made with the lighting element which is held on the mount 16. As a result, the lighting element can be supplied with electric current by means of the conduction layers 12, 14 and the mount 16 in order to thereby illuminate the room 11.

The mount 16 is arranged on the layers (conduction layers 12, 14 and insulation layer 18) such that it can move relative to the layers. In the present case, the mount 16 can be pivoted relative to the layers at least in a pivoting direction which is indicated by a directional arrow 34, as a result of which the lighting element which is held on the mount 16 can also be pivoted relative to the layers. As a result, the lighting element can be oriented relative to the layers in the room 11 in order to illuminate the room 11 as required and in a specific manner. In various embodiments, it is possible to illuminate at least a subregion of the room 11 in a specific manner by means of the lighting element, with the result that, for example, so-called spot-lighting can be realized.

The mount 16 is therefore assigned three functions since it serves to movably hold the lighting element on the layers, to cool the lighting element as a result of the very high degree of thermal conductivity of the mount 16 and of the conduction layers 12, 14, and also to supply electric current to the lighting element.

The mount 16 is held on the layers, for example, in an interlocking manner, with the result that separate and additional fastening elements for fastening the mount 16 to the layers can also be dispensed with. The mount 16 is inserted into the layers, for example, by pressing the mount 16 into the layers.

In the present case, the mount 16 has, in its subregion which is accommodated in the layers, an outer contour 36 which is designed at least substantially in the form of a sphere or in the form of a segment of a sphere in a first outer contour subregion 38. A second outer contour subregion 40 of the outer contour 36 adjoins the first outer contour subregion 38, wherein the second outer contour subregion 40 is designed, for example, at least substantially in the form of a cylinder and, in various embodiments, at least substantially in the form of a circular cylinder. In this case, the mount 16 is guided out of the layers and into the room 11 by way of its second outer contour subregion 40.

In this case, the respective inner contours of the layers correspond at least substantially to the outer contour 36. The mount 16 therefore makes contact, in various embodiments, with the conduction layers 12, 14 in a planar manner, with the result that both electric current can be supplied to the mount 16 in a highly effective manner and also waste heat can be transported away from the mount 16 to the conduction layers 12, 14 in a highly effective manner.

As can be seen in FIG. 1, the passage opening in the second conduction layer 14, through which conduction layer the mount 16 has passed, has at least one inner circumference which is larger than an outer circumference of the second outer contour subregion 40. In the present case, the passage opening in the conduction layer 14 is designed in such a way that it expands at least in regions in the direction of the room 11 and tapers in the correspondingly opposite direction, that is to say in the direction of the insulation layer 18. As a result, the mount 16 can be pivoted relative to the layers over a pivoting range until the mount 16 comes into supporting abutment with the second conduction layer 14 by way of its second outer contour subregion 40.

The design of the first outer contour subregion 38 in the form of a segment of a sphere constitutes a kind of ball-and-socket joint by means of which the mount 16 can be pivoted in at least virtually any desired pivoting direction. In various embodiments, pivoting perpendicular to the plane of FIG. 1 is also feasible for example.

In order to ensure that the respective positive poles are electrically insulated from the respective negative poles in spite of the ability of the mount 16 to pivot or to move relative to the layers, the shape and/or the extent, in various embodiments, of the insulation region 24 have to be designed in a corresponding manner and have to be correspondingly matched to the pivot range or to a movement range over which the mount 16 can move relative to the layers.

In the present case, the insulation region 24 is formed at least substantially in the form of a belt and extends in the circumferential direction of the first outer contour subregion 38 all the way around the mount 16.

As an alternative to the design of the outer contour 36 of the mount 16 which is illustrated with reference to FIG. 1, the outer contour 36 can, at least in regions and in various embodiments in the first outer contour subregion 38, at least substantially be in the form of a cylinder, in various embodiments of a straight circular cylinder. In this case, the mount 16 can be pivoted, for example, about a pivot axis, wherein the pivot axis is a center axis or an axis of symmetry of the cylindrical shape.

As can be seen with reference to FIG. 1, the paneling apparatus 10 can have at least one channel 42 which, in the present case, is provided in the first conduction layer 12 and extends in the conduction layer 12, for example, at least substantially in a helical manner or in a serpentine manner or in a meandering manner. In this case, a cooling medium, and in various embodiments cooling water, can flow through the channel 42, with the result that the conduction layer 12 and, by means of said conduction layer, the mount 16 and the lighting element which is held on the mount 16 can be particularly effectively cooled.

In the present case, the channel 42 is delimited by a conduction element 44 which is formed separately from the conduction layer 12 and which is accommodated with its outer circumference fully in the first conduction layer 12. In the present case, the conduction element 44 is formed by a copper pipe, but, as an alternative, can also be formed by a pipe which is formed from another metal material.

The conduction element 44 is preferably coupled to a cooling circuit through which the cooling water can flow. Therefore, heat can be transferred from the lighting element to the mount 16, from the mount 16 to the conduction layers 12, 14, from the conduction layer 12 to the conduction element 44, and from the conduction element 44 to the cooling water which flows through the channel 42, wherein the cooling water can transport away a particularly high quantity of heat over an only short period of time.

The cooling water which is heated as a result flows, for example, to a cooling device in the cooling circuit. The cooling water is cooled by means of the cooling device, with the result that it can then flow back through the conduction layer 12 and therefore transport away heat from said conduction layer.

As can also be seen in FIG. 1, the conduction layer 12 has a larger layer thickness t than the conduction layer 14 in the present case. As a result, it is possible, for example, to adjust the fitting and/or the ability of the mount 16 to pivot and also its electrical contact-connection to the conduction layers 12, 14 as desired.

Figure 2:
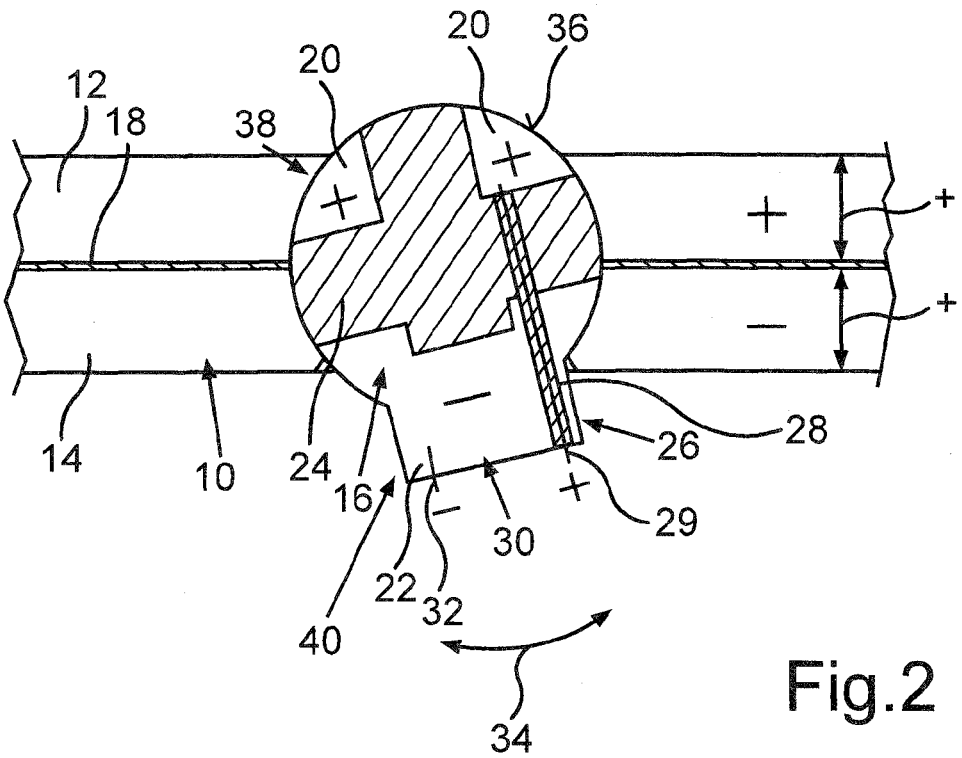
FIG. 2 shows a schematic side view of a detail of a second exemplary embodiment of a paneling apparatus according to various embodiments.

FIG. 2 shows a second exemplary embodiment of a paneling apparatus 10 which is designed in accordance with the refinement in FIG. 1 and differs from the paneling apparatus 10 according to FIG. 1 only in parts. Therefore, only the differences between the paneling apparatus 10 according to FIG. 1 and the paneling apparatus 10 according to FIG. 2 will be addressed in the text which follows.

According to FIG. 2, the conduction layers 12, 14 have at least substantially the same layer thicknesses t. As can also be seen in FIG. 2, the mount 16 passes through both the conduction layer 14 and the insulation layer 18 and the conduction layer 12 via respective, corresponding passage openings.

According to FIG. 2, the insulation region 24 of the mount 16 is designed at least substantially in the form of a cross. As a result, it is possible to ensure that the corresponding positive and negative poles are reliably electrically insulated from one another. Furthermore, particularly large adhesive-bonding areas by means of which the respective individual elements are adhesively bonded to one another can be realized as a result.

Figure 3:
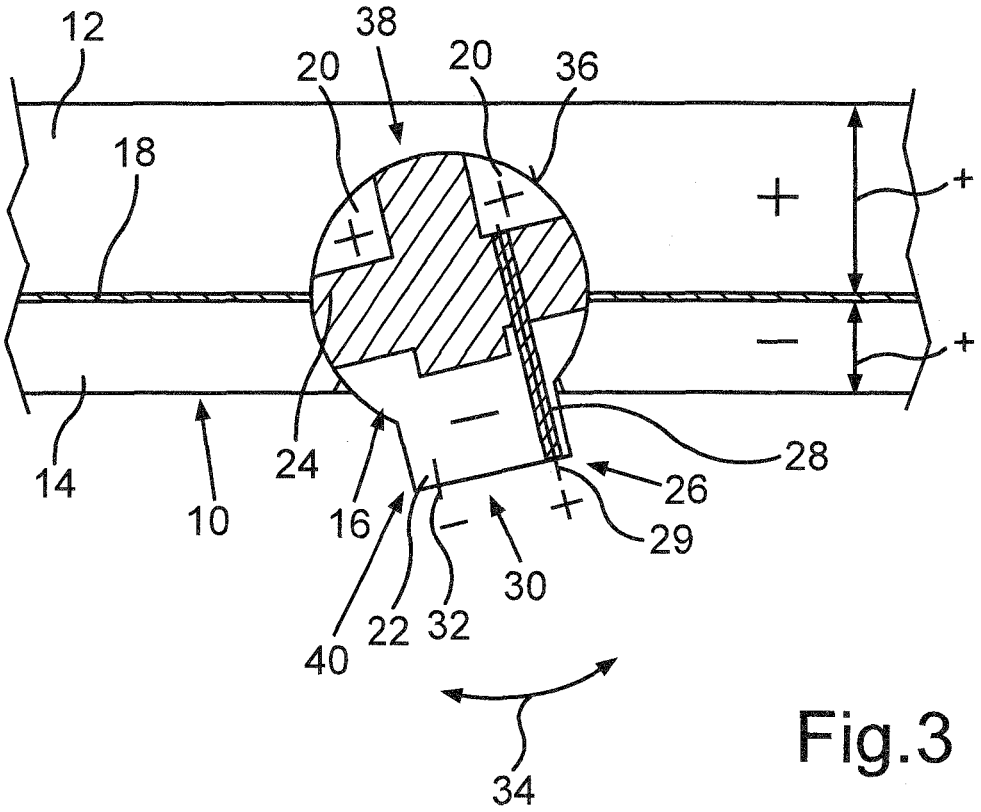
FIG. 3 shows a schematic side view of a detail of a third exemplary embodiment of a paneling apparatus according to various embodiments.

FIG. 3 shows a third exemplary embodiment of a paneling apparatus 10 which is designed in accordance with the refinement in FIG. 1 and FIG. 2. In the present case, the conduction layers 12, 14 have, as in FIG. 1, layer thicknesses t which differ from one another, wherein the mount 16 does not pass through the conduction layer 12, but rather is accommodated in the corresponding accommodation opening. According to FIG. 3, the insulation region 24 is designed at least substantially in the same manner as in FIG. 2 and is designed in the form of a cross.

The insulation region 24 therefore divides the positive electrical pole into two positive pole regions and therefore into two contact regions 20.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A paneling apparatus for a ceiling or a wall of a room, comprising: two electrically conductive conduction layers, which are arranged such that they overlap at least in regions, as first layers between which at least one insulation layer, which electrically insulates the conduction layers from one another, is arranged as a further layer, and having at least one contact-making device which, at least in a subregion, is accommodated in the layers and which has a first contact region, with which one of the conduction layers makes electrical contact, and has a second contact region, with which the other conduction layer makes electrical contact and which is electrically insulated from the first contact region, and is designed to enable the conduction layers to make electrical contact with at least one lighting element and also to hold the lighting element on the layers, wherein the contact-making device is arranged on the layers such that it can move relative to the layers, wherein at least one channel is at least partially provided in at least one of the layers, it being possible for a cooling medium to flow through said channel.

2. The paneling apparatus of claim 1, wherein at least one channel is at least partially provided in at least one of the conduction layers, it being possible for a cooling medium to flow through said channel.

3. The paneling apparatus of claim 1, wherein at least one channel is at least partially provided in at least one of the layers, it being possible for a cooling liquid to flow through said channel.

4. The paneling apparatus of claim 1, wherein the channel is delimited by at least one conduction element which is formed from a first material and is accommodated at least partially in the at least one layer, wherein the first material differs from a second material from which the at least one layer is formed.

5. The paneling apparatus of claim 1, wherein the conduction layers have different layer thicknesses from one another.

6. The paneling apparatus of claim 1, wherein the conduction layers are formed at least substantially from carbon.

7. The paneling apparatus of claim 6, wherein the conduction layers are formed at least substantially from graphite.

8. A paneling apparatus for a ceiling or a wall of a room, comprising: two electrically conductive conduction layers, which are arranged such that they overlap at least in regions, as first layers between which at least one insulation layer, which electrically insulates the conduction layers from one another, is arranged as a further layer, and having at least one contact-making device which, at least in a subregion, is accommodated in the layers and which has a first contact region, with which one of the conduction layers makes electrical contact, and has a second contact region, with which the other conduction layer makes electrical contact and which is electrically insulated from the first contact region, and is designed to enable the conduction layers to make electrical contact with at least one lighting element and also to hold the lighting element on the layers, wherein the contact-making device is arranged on the layers such that it can move relative to the layers, wherein the conduction layers are formed at least substantially from expanded graphite.

9. A paneling apparatus, comprising:

a first electrically conductive conduction layer extending in a first direction;

a second electrically conductive conduction layers arranged at least partially over the first electrically conductive layer in a second direction substantially perpendicular to the first direction;

at least one insulation layer, which electrically insulates the first conduction layer from the second conduction layers;

at least one contact-making device accommodated at least partially in the first and second conductive layers, the at least one contact-making device including:

a first contact region configured to electrically contact the first electrically conductive conduction layer; and a second contact region configured to electrically contact the second electrically conductive conduction layer and which is electrically insulated from the first contact region;

wherein the at least one contact-making device is configured to rotate at least in a plane defined by the first and second direction.

10. The paneling apparatus of claim 9, wherein the contact-making device is thermally coupled to at least one of the layers.

11. The paneling apparatus of claim 9, wherein the contact-making device is thermally coupled to at least one of the conduction layers.

12. The paneling apparatus of claim 9, wherein the contact-making device has, at least in its subregion which is accommodated in the layers, an outer contour in the plane which is of at least partially convex design.

13. The paneling apparatus of claim 12, wherein the outer contour is designed to be at least substantially in a form in the subregion selected from a group of forms consisting of: the form of a sphere; the form of a segment of a sphere; and the form of a circular cylinder.

14. The paneling apparatus of claim 12, wherein the outer contour is designed to be at least substantially in the form of a straight circular cylinder in the subregion.

15. The paneling apparatus of claim 9, wherein the contact-making device is held in an interlocking manner on at least one of the layers.

* * * * *